US010697405B2

(12) United States Patent
Ohrem et al.

(10) Patent No.: US 10,697,405 B2
(45) Date of Patent: Jun. 30, 2020

(54) EXHAUST GAS COOLER AND EXHAUST GAS RECIRCULATION SYSTEM WITH AN EXHAUST GAS COOLER

(71) Applicant: Hanon Systems, Daejeon (KR)

(72) Inventors: Carsten Ohrem, Bergheim (DE); Petr Sispera, Uhersky Ostroh (CZ); Jürgen Nothbaum, Aachen (DE); Jiri Tomecek, Vnorovy (CZ)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 16/033,323

(22) Filed: Jul. 12, 2018

(65) Prior Publication Data

US 2019/0093606 A1 Mar. 28, 2019

(30) Foreign Application Priority Data

Sep. 22, 2017 (DE) ..... 10 2017 216 819

(51) Int. Cl.

| | |
|---|---|
| ***F28D 7/16*** | (2006.01) |
| ***F02M 26/32*** | (2016.01) |
| ***F28D 7/06*** | (2006.01) |
| ***F28D 21/00*** | (2006.01) |
| ***F28D 9/00*** | (2006.01) |
| ***F28F 3/04*** | (2006.01) |
| ***F02M 26/12*** | (2016.01) |
| *F28F 9/02* | (2006.01) |

(52) U.S. Cl.

CPC ..... *F02M 26/32* (2016.02); *F02M 26/12* (2016.02); *F28D 7/06* (2013.01); *F28D 9/0056* (2013.01); *F28D 21/0003* (2013.01); *F28F 3/046* (2013.01); *F28F 2009/0287* (2013.01); *F28F 2265/26* (2013.01)

(58) Field of Classification Search

CPC ..... F28D 21/0003; F02M 26/32; F02M 26/12
USPC ..... 123/568.12, 568.13, 568.17, 568.18
See application file for complete search history.

(56) References Cited

U.S. PATENT DOCUMENTS

| | | | | |
|---|---|---|---|---|
| 2004/0182547 | A1* | 9/2004 | Birkert | B21D 17/025 165/83 |
| 2008/0257536 | A1* | 10/2008 | Kolblin | F28D 9/005 165/167 |
| 2014/0034028 | A1* | 2/2014 | Zhang | F28F 9/02 123/568.12 |
| 2014/0251579 | A1* | 9/2014 | Sloss | F01N 5/02 165/96 |
| 2016/0208745 | A1* | 7/2016 | Neher | F02M 26/31 |

FOREIGN PATENT DOCUMENTS

| | | | |
|---|---|---|---|
| DE | 102011014704 | A1 | 9/2012 |
| JP | 2007078194 | A | 3/2007 |
| JP | 2014514532 | A | 6/2014 |
| JP | 2015025604 | A | 2/2015 |
| JP | 2016217654 | A | 12/2016 |

* cited by examiner

*Primary Examiner* — Hai H Huynh
*Assistant Examiner* — Gonzalo Laguarda
(74) *Attorney, Agent, or Firm* — Shumaker, Loop & Kendrick, LLP; James D. Miller

(57) ABSTRACT

An exhaust gas cooler comprises at least one exhaust gas pipe for exhaust gas being cooled and is characterized in that at least one gap is provided between the wall of the exhaust gas pipe and laterally adjacent components at the inlet of at least one exhaust gas pipe in the direction of extension of at least one wall perpendicular to the flow direction of the exhaust gas.

13 Claims, 1 Drawing Sheet

EXHAUST GAS COOLER AND EXHAUST GAS RECIRCULATION SYSTEM WITH AN EXHAUST GAS COOLER

CROSS-REFERENCE TO RELATED PATENT APPLICATION

This patent application claims the benefit of German Patent Application No. DE 10 2017 216 819.6 filed Sep. 22, 2017, the entire disclosure of which is hereby incorporated herein by reference.

FIELD OF THE INVENTION

The invention relates to an exhaust gas cooler as well as an exhaust gas recirculation system with at least one such exhaust gas cooler.

In the field of internal combustion engines it is customary to recirculate exhaust gas to a certain extent back to the fresh air side, in order to reduce the fuel consumption and lessen emissions. At least in certain operating states, it is necessary to cool the recirculated exhaust gas.

BACKGROUND OF THE INVENTION

In this regard, it is known, for example from JP 5941878 B2, how to channel the exhaust gas through numerous exhaust gas pipes, which are received in a housing, so that a flow can be generated with a liquid coolant, for example, such as water/glycol, between housing and the exhaust gas pipes, or between the exhaust gas pipes. However, in this case the cooler is heated, especially at the gas inlet side, which means that it has a much higher temperature here than in the further stretch. This results in an inhomogeneous temperature distribution in the material of the cooler and thus in stresses. In particular, temperature changes of the gas as well as the coolant such as occur on account of the nonstationary operating behavior of the internal combustion engine (e.g., cold starting, changing load, AGR rate, etc.) result in further inhomogeneities in the temperature distribution, given different material thicknesses and thus different temperature change rates, which result in the aforementioned stresses.

In the region of the gas inlet, such inhomogeneities occur in an especially critical form, since on the one hand the thin front edges of the exhaust gas pipes encounter the uncooled hot exhaust gas mass flow and can only give off the introduced heat slowly to the cooling water on account of their thin walls. On the other hand, the exhaust gas pipes here are usually joined at the sides to a housing, which has a much greater wall thickness and whose temperature therefore changes with greater inertia, or the housing walls are not directly exposed to the hot exhaust gas mass flow. In many applications, a thick-walled flange is situated outside the housing, which further intensifies the situation. The heated exhaust gas pipes expand in the inlet region, and since the temperature of the housing and/or the flange has not yet changed enough to result in a similar expansion, this differential expansion results in stresses.

The stresses result in a plastic deformation in the thinner component, the front edges of the exhaust gas pipe, which become compressed and/or form corrugations. Upon cooldown, either the relatively thin sheet metal cools down more quickly, or all the mentioned components cool down at the same time, but the compressed sheet metal must return to its starting position and expand, which creates tensile stresses in the front edge of the exhaust gas pipe. This alternating loading and plastic deformation results in failure of the material of the exhaust gas pipe. In this regard, one must also consider the fact that an exhaust gas cooler must withstand the described alternating loading for several 100,000 times in the course of its lifetime.

SUMMARY OF THE INVENTION

Given this background, the problem which the invention proposes to solve is to create a permanently stable and at the same time more economical exhaust gas cooler.

The solution of this problem occurs by the exhaust gas cooler described herein.

Accordingly, at least one gap is provided relative to laterally adjacent components at the inlet of at least one exhaust gas pipe. In other words, at least one exhaust gas pipe in its direction of extension perpendicular to the flow direction is not fastened to surrounding components, such as a housing and/or a flange, but instead a gap is situated immediately laterally adjacent to at least one wall of the pipe, and adjacent to at least one end, preferably to all walls, so that the pipe can expand freely when heated in a direction perpendicular to the flow direction. In this way, the above-described stresses and plastic deformations do not arise upon expansion, resulting in damage. The connection between the exhaust gas pipes and the housing occurs downstream from the gas flow, at a position where a homogeneous temperature distribution is to be expected. In addition, the coolant is advantageously channeled in such a way that it provides good cooling across all the parts of such a connection.

It should be added that the respective wall of the exhaust gas pipe may be viewed as a thin plate, which extends on the one hand in the flow direction and on the other hand perpendicular to the flow direction. Furthermore, the thickness direction of the plate also extends perpendicular to the flow direction, but it is not important according to the invention to provide gaps in the thickness direction, in other words, given a horizontal orientation of the wall, to provide gaps above or below the wall, but rather at its sides, in other words, "next to" the wall in the described direction of extension perpendicular to the flow direction. If a gap is provided here, unlike what is customary in the prior art, preferably on both sides, the effect according to the invention can be utilized.

It should further be added that the exhaust gas cooler according to the invention comprises flat tubes, which can be stacked such that the long sides of the rectangular cross section of such a flat tube at the same time form the boundary of adjacent exhaust gas pipes. The gaps according to the invention are provided preferably for these long sides.

Preferred modifications are described herein.

For the dimensioning of the described gap in the flow direction of the exhaust gas, good results are achieved with a minimum length of 5 mm and/or a maximum extension of 2 cm.

The same holds for a dimension perpendicular to the flow direction of at least 1 mm and/or up to 5 mm.

For an extensive heat transfer from the exhaust gas to the coolant bathing the exhaust gas pipes, at least one exhaust gas pipe has ribs or fins on the inside, which may be undulating in configuration in the flow direction.

The benefits of the invention can be utilized in particular in an exhaust gas cooler with at least one exhaust gas pipe, having at least one wall with a thickness of 0.3 mm to 0.5 mm. Such a pipe is configured relatively thin and thus "lightweight", and at the same time damage at the inlet can be prevented by the measures according to the invention.

Typically, the exhaust gas pipes are surrounded by a housing and/or a flange, which have a wall with a thickness of 1.0 mm to 1.5 mm and/or a thickness of 5 mm to 8 mm. In this way, the housing and/or the flange are significantly thicker and more stable than the exhaust gas pipes and they therefore provide the exhaust gas cooler as a whole with an advantageous stability. At the same time, they do not secure the inlet regions of the exhaust gas pipes thanks to the measures of the invention, so that the described problems can be avoided.

Further gaps are provided laterally next to the pipe along the course of at least one exhaust gas pipe in the flow direction, so that a bathing in a flow of coolant is possible here, and at the same time a defined fastening of the exhaust gas pipe can be achieved at defined locations between the described gaps, for example on the surrounding housing.

The exhaust gas cooler according to the invention produces special benefits when used as an exhaust gas recirculation cooler.

Accordingly, further subject matter of the invention is an exhaust gas recirculation system with at least one such cooler.

BRIEF DESCRIPTION OF THE DRAWINGS

In the following, a sample embodiment of the invention as shown in the figures shall be explained more closely. There is shown.

DETAILED DESCRIPTION OF AN EMBODIMENT OF THE INVENTION

Figure 1:
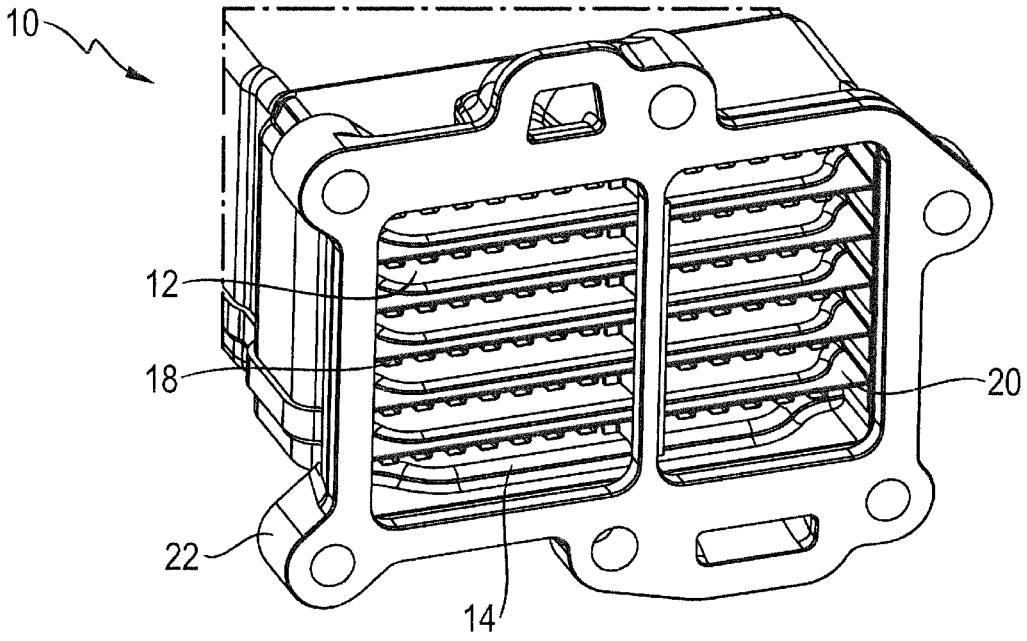
FIG. 1 is a perspective partial view of an exhaust gas cooler according to the invention.

As can be seen from FIG. 1, an exhaust gas cooler 10 according to the invention has a substantially rectangular cross section and an elongated extension (upward to the left in FIG. 1) in the illustrated case. By means of a flange 22, the exhaust gas cooler 10 may be attached to an exhaust gas (recirculation) line, which is not shown, or connected to a valve housing, especially an AGR valve (or to an AGR module). The flange 22 may be cast, for example, and the following described walls of exhaust gas pipes 12, ribs 18 provided in them, and a housing 26 may be formed from appropriately bent sheet metal. On an inside of the exhaust gas cooler 10, there are numerous exhaust gas pipes 12, which are formed substantially by metal plates 20 oriented parallel to each other, relatively flat side walls, and the ribs or fins 18 arranged between them, which can be better seen in the cross sectional top view of FIG. 2. The plates 20 thus form walls of the exhaust gas pipes 12, designed as flat tubes, and may therefore experience damage on account of the expansion and contraction as described above.

Figure 2:
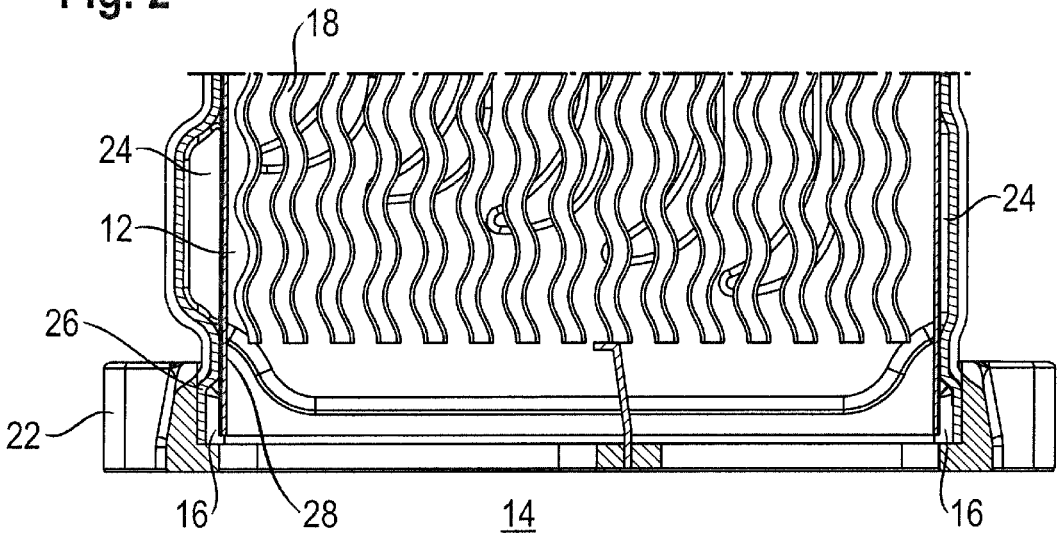
FIG. 2 is a fragmentary cross sectional view of the inlet region of an exhaust gas cooler according to the invention

It can be seen from FIG. 2 that the housing 26 is provided between the flange 22 and the exhaust gas pipes 12, surrounding the numerous exhaust gas pipes 12, so that the exhaust gas pipes 12 closed at the sides can be bathed in a liquid coolant, such as water, in order to cool the exhaust gas flowing through the exhaust gas pipes 12.

The housing 26 is respectively connected on an outside to the massive flange 22, but according to the invention a gap 16 is situated at an inlet 14 of a respective one of the exhaust gas pipes 12 and at a side thereof, which is visible at the left and right side in FIG. 2, advantageously making possible an expansion of the respective one of the exhaust gas pipes 12 when heated as a result of the flow of the hot exhaust gas through it. The lateral extension, in other words the extension perpendicular to the flow direction (from bottom to top in FIG. 2) can be seen at left and right in FIG. 2. The extension of the gaps 16 in the flow direction up to a fastening point 28 of the exhaust gas pipes 12 to the housing 26 likewise runs from bottom to top in FIG. 2 and preferably amounts to 5 mm to 2 cm. Further gaps 24 are provided in the further course of the connection between the housing 26 and the exhaust gas pipe 12.

FIG. 2 moreover shows a wave shape of the ribs running in the flow direction in the embodiment shown.

The fastening point 28 in the sample embodiment shown extends for at least a few millimeters, such as 5 millimeters and/or up to 2 cm in the flow direction. Accordingly, the following is evident: if the fastening point 28 in such an embodiment were provided directly at the upstream end of the plate or the wall 20, and thus at the inlet, it is not possible to supply coolant here on account of the extension of the fastening point 28 in the flow direction. Accordingly, the above described problem arises, which is solved by the gap 16 according to the invention, which shifts the fastening point 28 to a certain extent downstream in the flow direction.

In the embodiment shown, the flange 22 has a thickness, measured in the flow direction, which is larger than the extension of the gap 16, in order to achieve an overall stable configuration.

According to the sample embodiment, the exhaust gas cooler 10 has two inlets arranged alongside each other and adjacent to these, "stacked" groups of exhaust gas pipes 12, but the exhaust gas cooler according to the invention may likewise have a single inlet and an adjacent group of exhaust gas pipes 12, as well as more than two inlets and correspondingly provided exhaust gas pipes 12.

What is claimed is:

1. An exhaust gas cooler comprising:

at least one exhaust gas pipe configured to receive an exhaust gas flowing through an interior of the at least one exhaust gas pipe, wherein the at least one exhaust gas pipe is a flat tube having a wall with a substantially rectangular cross-section with two opposing short sides and two opposing long sides, wherein an inlet end of the at least one exhaust gas pipe is surrounded by each of a housing and a flange, wherein a first gap is provided between a first one of the short sides of the wall of the at least one exhaust gas pipe and each of the housing and the flange at the inlet end of the at least one exhaust gas pipe, wherein the at least one exhaust gas pipe includes a fastening point at which the first one of the short sides of the wall of the at least one exhaust gas pipe is coupled to the housing at a position downstream of the inlet end of the at least one exhaust gas pipe with respect to a flow direction of the exhaust gas through the interior of the at least one exhaust gas pipe.

2. The exhaust gas cooler as claimed in claim 1, wherein the first gap extends between 5 mm and 2 cm in the flow direction of the exhaust gas between the inlet end of the at least one exhaust gas pipe and the fastening point.

3. The exhaust gas cooler as claimed in claim 1, wherein the first gap extends between 1 mm and 5 mm in a direction perpendicular to the flow direction of the exhaust gas.

4. The exhaust gas cooler as claimed in claim 1, wherein the at least one exhaust gas pipe has fins on an inside thereof.

5. The exhaust gas cooler as claimed in claim 1, wherein the wall has a thickness of 0.3 to 0.5 mm.

6. The exhaust gas cooler as claimed in claim 1, wherein the housing has at least one wall with a thickness of 1 to 1.5 mm and the flange has a thickness of 5 to 8 mm.

7. The exhaust gas cooler as claimed in claim 1, wherein the exhaust gas cooler is an exhaust gas recirculation cooler.

8. An exhaust gas recirculation system with at least one exhaust gas cooler as claimed in claim 7.

9. The exhaust gas cooler as claimed in claim 1, wherein the housing circumscribes the at least one exhaust gas pipe at the inlet end thereof.

10. The exhaust gas cooler as claimed in claim 9, wherein the flange circumscribes the housing at the inlet end of the at least one exhaust gas pipe.

11. The exhaust gas cooler as claimed in claim 1, wherein the fastening point of the at least one exhaust gas pipe is located downstream of the flange with respect to the flow direction of the exhaust gas.

12. The exhaust gas cooler as claimed in claim 1, wherein an exterior of the at least one exhaust gas pipe is exposed to the exhaust gas upstream of the fastening point with respect to the flow direction of the exhaust gas while the exterior of the at least one exhaust gas pipe is exposed to a coolant downstream of the fastening point with respect to the flow direction of the exhaust gas.

13. The exhaust gas cooler as claimed in claim 1, wherein a second gap is provided between a second one of the short sides of the wall of the at least one exhaust gas pipe and each of the housing and the flange at the inlet end of the at least one exhaust gas pipe.

* * * * *